US008839752B2

(12) United States Patent
Burrows et al.

(10) Patent No.: US 8,839,752 B2
(45) Date of Patent: Sep. 23, 2014

(54) CORONA IGNITER WITH MAGNETIC SCREENING

(76) Inventors: John A. Burrows, Northwich (GB); James D. Lykowski, Temperance, MI (US)

( * ) Notice: Subject to any disclaimer, the term of this patent is extended or adjusted under 35 U.S.C. 154(b) by 902 days.

(21) Appl. No.: 13/006,555

(22) Filed: Jan. 14, 2011

(65) Prior Publication Data

US 2012/0180743 A1 Jul. 19, 2012

(51) Int. Cl.
*H01T 13/44* (2006.01)
*H01T 13/50* (2006.01)
*H01F 27/36* (2006.01)

(52) U.S. Cl.
CPC ..... *H01T 13/50* (2013.01); *H01F 27/365* (2013.01); *H01T 13/44* (2013.01)
USPC ..... 123/143 B; 123/169 R; 123/143 C

(58) Field of Classification Search
CPC ..... H01T 13/40; H01T 13/41; H01T 13/05; H01T 13/08; H01T 13/44; H01T 13/50; F02P 7/025; F02P 13/00; H04B 15/00; H04B 15/02; H04B 15/025; H01F 38/12; H01F 27/365
USPC ..... 123/630, 633, 634, 143 B, 432, 169 R, 123/143 C; 439/125, 126, 127, 128; 174/397; 313/134; 361/254
See application file for complete search history.

(56) References Cited

U.S. PATENT DOCUMENTS

| | | | | | |
|---|---|---|---|---|---|
| 1,988,859 | A | * | 1/1935 | Shumaker | 123/169 PH |
| 2,108,635 | A | * | 2/1938 | Aiken et al. | 439/126 |
| 2,114,750 | A | * | 4/1938 | Stone | 439/126 |
| 2,301,572 | A | * | 11/1942 | Nowosielski | 123/169 PH |
| 2,399,390 | A | * | 4/1946 | Robertson | 439/126 |
| 3,128,139 | A | * | 4/1964 | Estes | 439/126 |
| 3,191,132 | A | * | 6/1965 | Mayer | 333/184 |
| 3,566,202 | A | * | 2/1971 | Carr | 361/270 |
| 3,626,085 | A | * | 12/1971 | Arndt et al. | 174/3 |
| 3,657,469 | A | * | 4/1972 | Ryder | 174/73.1 |
| 3,803,529 | A | * | 4/1974 | Rohrig et al. | 439/126 |
| 3,881,051 | A | * | 4/1975 | Berry | 174/397 |
| 3,993,387 | A | * | 11/1976 | Venezia | 439/89 |

(Continued)

FOREIGN PATENT DOCUMENTS

| | | | | |
|---|---|---|---|---|
| DE | 102008041085 A1 | | 2/2009 | |
| FR | 2859831 A1 | | 9/2012 | |
| JP | 63136305 A | * | 6/1988 | G11B 5/11 |
| WO | 2008/047013 | | 4/2008 | |

OTHER PUBLICATIONS

Glenn R. Skutt, "High Frequency Dimensional Effects in Ferrite-Core Magnetic Devices", 1996, Chapters 1-2.*

(Continued)

*Primary Examiner* — Hai Huynh
*Assistant Examiner* — Raza Najmuddin
(74) *Attorney, Agent, or Firm* — Robert L. Stearns; Dickinson Wright, PLLC

(57) ABSTRACT

The invention relates to a corona ignitor device configured to be fixed within a combustion chamber, including a housing extending between an upper end and a lower end of the ignitor device. Inductor windings are received in the housing between the upper and lower ends, and a magnetic shield located between the housing and the inductor windings prevent magnetic flux from emanating out of the ignitor device.

13 Claims, 6 Drawing Sheets

(56) References Cited

U.S. PATENT DOCUMENTS

| | | | | | |
|---|---|---|---|---|---|
| 4,465,331 | A | * | 8/1984 | Masuda et al. | 439/95 |
| 4,497,532 | A | * | 2/1985 | Bezusko et al. | 439/485 |
| 4,514,712 | A | * | 4/1985 | McDougal | 336/96 |
| 4,621,881 | A | * | 11/1986 | Johansson et al. | 439/125 |
| 4,671,586 | A | * | 6/1987 | DeBolt | 439/126 |
| 4,893,015 | A | | 1/1990 | Kubierschky et al. | |
| 5,144,935 | A | | 9/1992 | Taruya et al. | |
| 5,146,906 | A | * | 9/1992 | Agatsuma | 123/634 |
| 5,163,838 | A | * | 11/1992 | Tura et al. | 439/126 |
| 5,209,195 | A | * | 5/1993 | Nakagawa et al. | 123/146.5 A |
| 5,291,872 | A | * | 3/1994 | Ghaem | 123/620 |
| 5,348,486 | A | * | 9/1994 | Tura et al. | 439/125 |
| 5,359,981 | A | * | 11/1994 | Kim | 123/633 |
| 5,767,758 | A | | 6/1998 | Sakamaki | |
| 5,799,633 | A | * | 9/1998 | Miller | 123/143 C |
| 5,870,012 | A | | 2/1999 | Sakamaki et al. | |
| 5,975,926 | A | * | 11/1999 | Uchiyama et al. | 439/126 |
| 6,005,464 | A | | 12/1999 | Sakamaki et al. | |
| 6,011,457 | A | | 1/2000 | Sakamaki et al. | |
| 6,023,215 | A | * | 2/2000 | Sakamaki et al. | 336/96 |
| 6,068,784 | A | * | 5/2000 | Collins et al. | 216/68 |
| 6,085,710 | A | * | 7/2000 | Uchiyama et al. | 123/169 PH |
| 6,215,385 | B1 | | 4/2001 | Ogden | |
| 6,308,696 | B1 | | 10/2001 | Kondo et al. | |
| 6,343,595 | B1 | | 2/2002 | Nakabayashi et al. | |
| 6,545,415 | B1 | | 4/2003 | Ward | |
| 6,679,236 | B2 | | 1/2004 | Skinner et al. | |
| 6,883,507 | B2 | | 4/2005 | Freen | |
| 7,228,853 | B1 | | 6/2007 | Skinner et al. | |
| 7,777,401 | B2 | | 8/2010 | Jaffrezic et al. | |
| 2002/0101316 | A1 | * | 8/2002 | Hamer et al. | 336/96 |
| 2006/0119459 | A1 | * | 6/2006 | Skinner et al. | 336/96 |
| 2007/0262721 | A1 | * | 11/2007 | Camilli | 315/32 |
| 2010/0132677 | A1 | * | 6/2010 | Skinner et al. | 123/621 |
| 2010/0175653 | A1 | | 7/2010 | Lykowski | |
| 2010/0187999 | A1 | | 7/2010 | Agneray | |
| 2012/0212313 | A1 | * | 8/2012 | Burrows | 336/90 |

OTHER PUBLICATIONS

International Search Report PCT/US2012/021182 mailed on May 16, 2012.

* cited by examiner

CORONA IGNITER WITH MAGNETIC SCREENING

BACKGROUND OF THE INVENTION

1. Technical Field

This invention relates generally to ignitors used for igniting air/fuel mixtures in automotive application and the like.

2. Related Art

Conventional spark plugs generally utilize a ceramic insulator which is partially disposed within a metal shell and extends axially toward a terminal end. A conductive terminal is disposed within a central bore at the terminal end, where the conductive terminal is part of a center electrode assembly disposed within the central bore. At the opposite/spark forming end, the center electrode is disposed within the insulator and has an exposed sparking surface which together with a ground electrode disposed on the shell defines a spark gap. Many different insulator configurations are used to accommodate a wide variety of terminal, shell and electrode configurations.

U.S. Pat. No. 6,883,507 discloses an ignitor for use in a corona discharge air/fuel ignition system. FIG. 1 is a diagram of a corona discharge ignition system according to the prior art. A feed-through insulator surrounds an electrode 13 as it passes through a cylinder head 19 into the combustion chamber 25. The insulator is fixed in an electrode housing 11 which may be a metal cylinder. A space 15 between the electrode housing 11 and the electrode 13 may be filled with a dielectric gas or compressed air. Control electronics and primary coil unit 7, secondary coil unit 9, electrode housing 11, electrode 13 and feed-through insulator together form an ignitor 5 which may be inserted into space 17. Ignitor 5 can be threaded into the cylinder head 19 during operation.

U.S. Publication No. 20100187999 discloses a device including two plasma generation electrodes, a series resonator and an induction coil surrounded by a screen. FIG. 2 illustrates components of a corona discharge combustion system according to the prior art. A spark plug used in a plasma generating system in accordance with the prior art. Spark plug 29 may be fixed to the cylinder head 39 of an internal combustion engine 105 of a motor vehicle. The spark plug 29 comprises a low-voltage cylindrical electrode which acts as a metal shell 37 intended to be screwed into a recess made in the cylinder head of an engine and which opens to the inside of the combustion chamber. An electrode is insulated from the shell 37 by an insulating sleeve. The insulating sleeve is made of a material the relative permittivity of which is greater than 1, for example a ceramic. The spark plug has a gap 41 separating the dielectric 100 from one end of the electrode 37.

The spark plug 29 also includes a shield 31 connected to ground and surrounding an inductive coil 33. The field lines are thus closed on themselves inside the shield 31. The shield 31 thus reduces the parasitic electromagnetic emissions of the spark plug 29. The coil 33 can actually generate intense electromagnetic fields with the radiofrequency excitation that is intended to be applied between the electrodes. These fields may, in particular, disrupt systems carried on board a vehicle or exceed the threshold levels defined in emission standards. The shield 31 is preferably made of a non-ferrous metal with high conductivity, such as copper or silver. In particular it is possible to use a conductive loop as a shield 31. The coil 33 and the shield 31 are preferably separated by an insulating sleeve 35 made of a suitable dielectric material, with a dielectric coefficient greater than 1, and preferably a good dielectric strength in order further to reduce the risk of breakdown or corona discharge, which cause energy to be dissipated. Provision may be made for the exterior surface of the sleeve 35 to be metalized in order to form the aforementioned shield 31.

SUMMARY OF THE INVENTION

In one embodiment of the invention, there is an ignitor assembly for an internal combustion engine fuel/air ignition system, including an upper inductor subassembly having a tubular housing extending between an upper end and a lower end with inductor windings received in said housing between said upper and lower ends and having an upper electrical connector adjacent said upper end of said housing and a lower electrical connector adjacent said lower end of said housing, said upper electrical connector being configured in electrical communication with said lower electrical connector via said inductor windings; a lower firing end subassembly having a ceramic insulator and a metal housing surrounding at least a portion of said ceramic insulator, said ceramic insulator extending between a terminal end and a firing end with an electrical terminal extending from said terminal end in electrical contact with said lower electrical connector and an electrode extending from said firing end, said electrode being configured in electrical communication with said electrical terminal; and a magnetic shield located between the housing and the inductor windings to prevent magnetic flux from emanating out of the ignitor assembly.

In another embodiment of the invention, there is a corona ignitor device configured to be fixed within a combustion chamber, including a housing extending between an upper end and a lower end of the ignitor device; inductor windings received in said housing between said upper and lower ends; and a magnetic shield located around the inductor windings to prevent magnetic flux from emanating out of the ignitor device.

In one aspect of the invention, there is an external conductive shield at least partially surrounding the housing to limit radiation of EM interference.

In another aspect of the invention, the magnetic shield has a relatively high magnetic permeability with low electrical conductivity and encloses the inductor windings to prevent the magnetic flux from emanating out of the ignitor assembly.

In still another aspect of the invention, the magnetic shield is a ferrite or suitable powdered metal material.

In yet another aspect of the invention, the magnetic shield has low losses in the frequency range 500 KHz to 5 MHz and an electrical resistivity to at least limit eddy current losses.

As an alternative to the resin or gas, we may use a suitable oil or the inductor may be filled with mostly air and made physically large enough to avoid flashover.

In yet another aspect of the invention, the inductor windings surround a central core, the central core is magnetically permeable and at least as long as the inductor windings, and the magnetic shield is a least as long as the central core.

In another aspect of the invention, the magnetic shield extends beyond the ends of the central core by a distance at least equal to the radius of the inductor windings.

In still another aspect of the invention, air gaps are introduced into the magnetic shield material or into the central core.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF A PREFERRED EMBODIMENT

Current designs of igniters for microwave or RF ignition systems for installation into the plug well of an engine suffer high loss and a reduction in inductance due to magnetic flux linking to the shield or conductive cylinder head, and create large eddy current losses. These issues are not easily avoided, as steps to reduce eddy current also reduce magnetic screening, allowing the magnetic field to penetrate further into the engine structure. This invention includes a magnetic flux inside the igniter body, thereby eliminating uncontrolled eddy current losses and changes in inductance.

Figure 1:
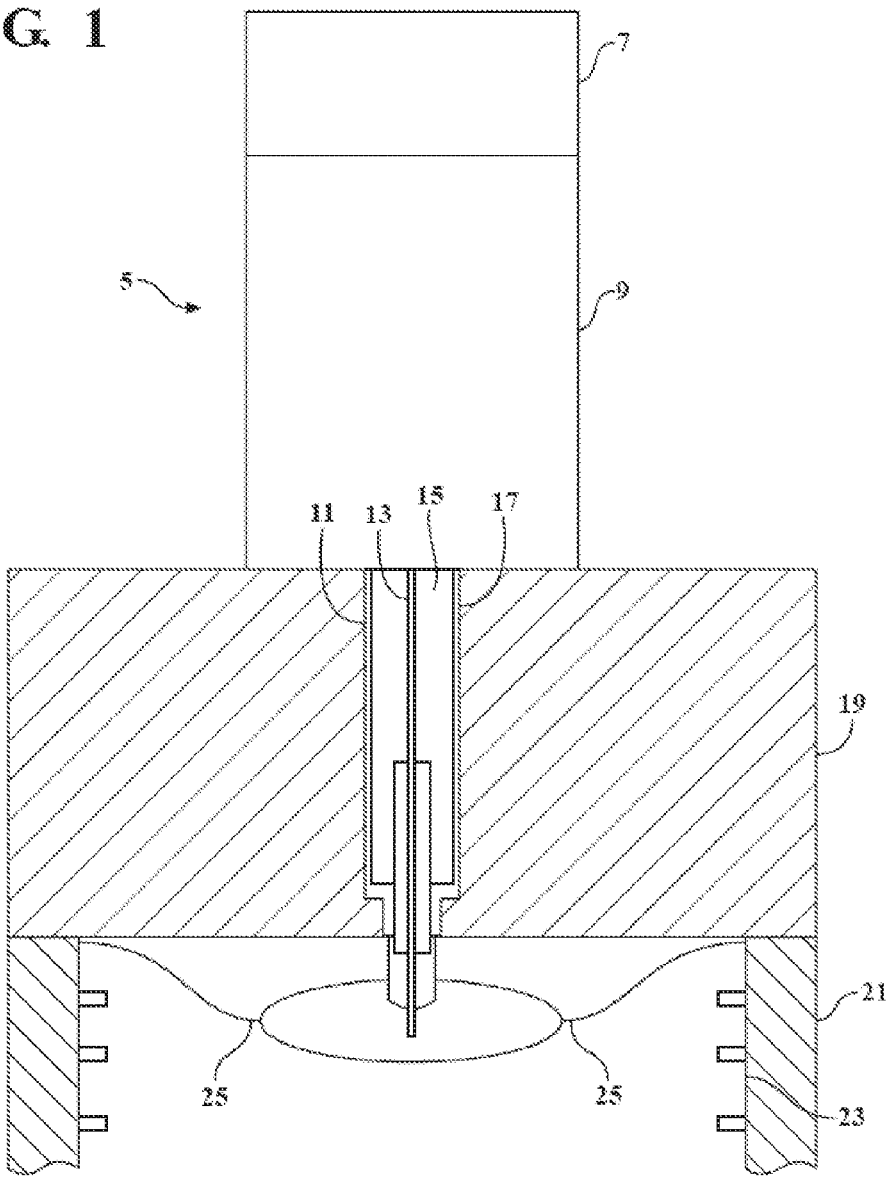
FIG. 1 is a diagram of a corona discharge ignition system according to the prior art.
Figure 2:
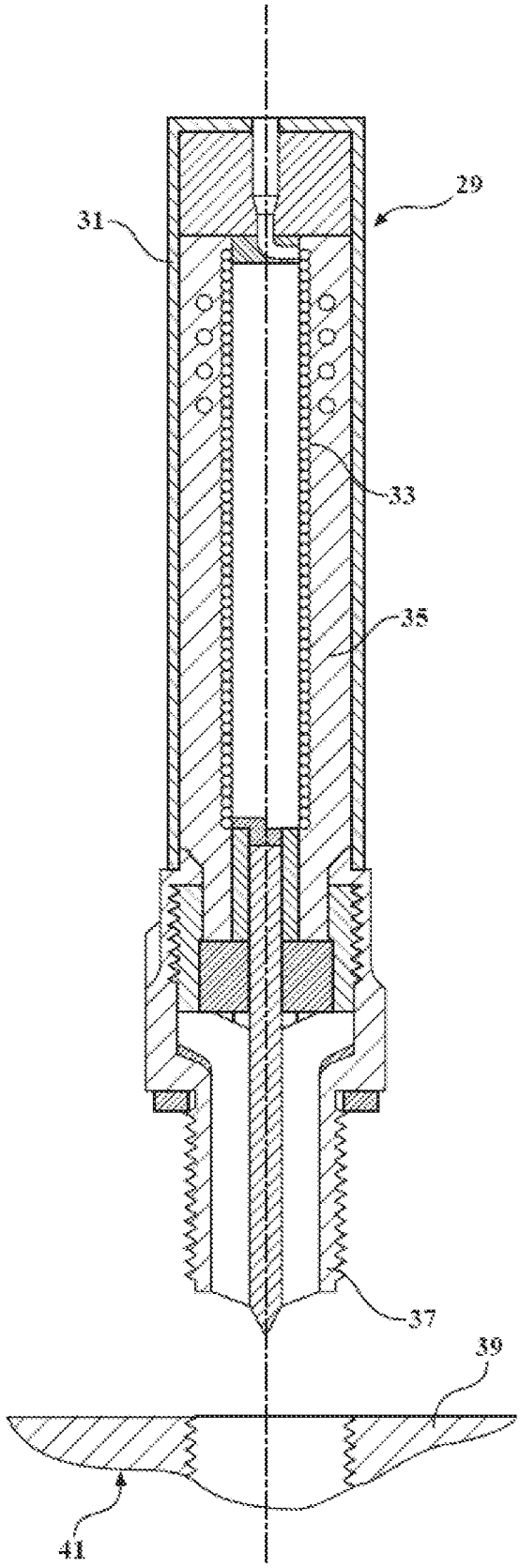
FIG. 2 illustrates components of a corona discharge combustion system according to the prior art.
Figure 3:
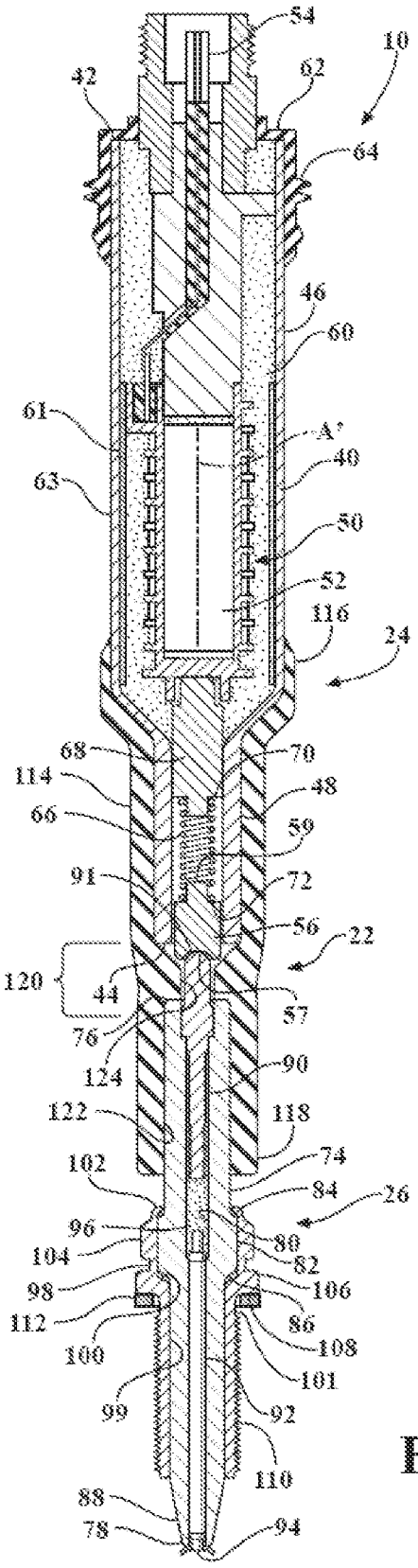
FIG. 3 is a cross-sectional view of an ignitor assembly according to the invention.

FIGS. 3-6 show an ignitor assembly, represented as a corona discharge ignitor assembly, and referred to hereafter as assembly 10, constructed in accordance with one aspect of the invention. FIG. 3 illustrates a cross-sectional view of an ignitor assembly according to the invention. The upper inductor subassembly 24 includes a plastic tubular housing 40 that extends along a first axis A' between an upper end 42 and a lower end 44. The housing 40 is shown here as having an enlarged diameter upper portion 46 and a lower portion 48 that is reduced in diameter from the upper portion 46. The upper portion 46 is sized appropriately to receive the desired configuration of the inductor winding, also referred to as a coil 50. The coil 50 is wound about a central core 52 and is in electrical communication with an upper electrical connector 54 adjacent the upper end 42 of the housing 40 and a lower electrical connector 56 adjacent the lower end 44 of the housing 40. Between housing 40 and coil 50 is a magnetic shield 61, described in more detail below with reference to FIGS. 4 and 5. Surrounding the external housing 40 is an external conductive shield 63. It is appreciated that the illustrations provide embodiments, but are not limiting. Specifically, it is appreciated that the magnetic shield does not need to be inside the housing and the electrical screen does not need to be outside the housing. That is, the magnetic shield, electrical screen and housing may be in any order.

Figure 6:
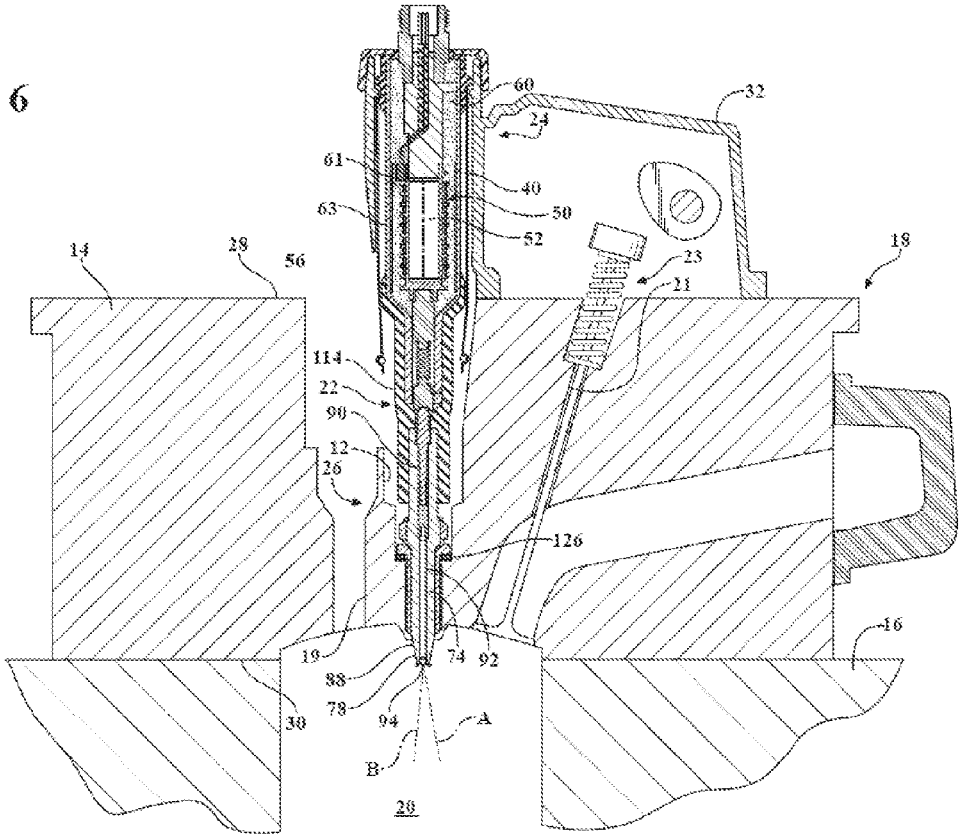
FIG. 6 is a cross-sectional view of the ignitor assembly of FIG. 3 shown installed within an internal combustion engine.

The housing 40 is either filled with a pressurized gas or resin 60 about the coil 50 and the housing 40 for high voltage suppression. The resin 60 fills or substantially fills any voids within the upper portion 46 of the housing 40. It is appreciated, however, that the housing 40 may be filled with any other material or composition, including air, not described herein. A polymeric or rubber cap 62 extends circumferentially about the upper end 42 of the housing 40 and is shown as having annular projections or ribs 64 extending radially outwardly from the housing 40 to facilitate fixing and forming a seal between the housing 40 and the cylinder head cover 32 (FIG. 6).

The lower firing end subassembly 26 includes an elongate ceramic insulator 74 extending between an upper terminal end 76 and a lower firing end 78 with central through passage 80 extending there-between. The insulator 74 has an enlarged diameter intermediate section 82 providing radially outwardly extending upper and lower shoulders 84, 86, respectively. The insulator 74 also has a tapered nose 88 converging to the firing end 78. An electrical terminal 90 is received within the central through passage 80 and extends from the terminal end 76 of the bore 56 to a free end 91, shown as being convex, for pivotal electrical communication with the lower electrical connector 56 of the upper inductor subassembly 24. A central electrode 92 is received within the central through passage 80 and extends from the firing end 78 to a free discharge end 94 which, when the ignitor assembly 10 is installed in the cylinder head 14 (FIG. 6), projects into the combustion cylinder 20 of the engine 18 (FIG. 6). The terminal 90 and the central electrode 92 are configured in electrical communication with one another. The lower firing end subassembly 26 further includes an outer metal jacket, also referred to as housing or shell 98. The shell 98 surrounds at least a portion of the ceramic insulator 74 in fixed relation thereto.

Figure 4:
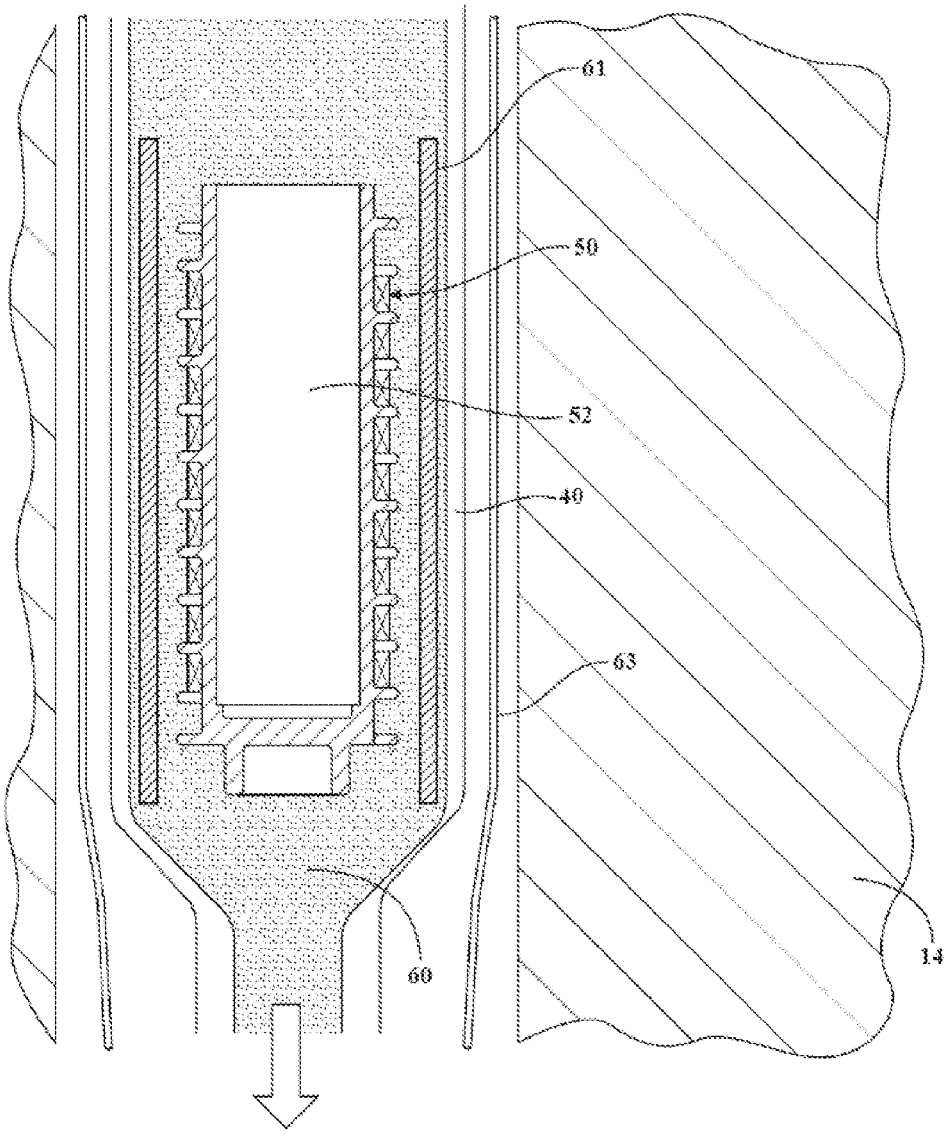
FIG. 4 is an exploded view of the ignitor assembly of FIG. 3 according to one embodiment of the invention.

FIG. 4 is an exploded view of the ignitor assembly of FIG. 3 according to one embodiment of the invention. An external layer of material 61 (external magnetic shield) having relatively high magnetic permeability, but low electrical conductivity, encloses the winding 50 of the igniter's inductor so as to prevent significant magnetic flux from penetrating out of the igniter body 10. This prevents the flux from linking with external conductive bodies (usually metallic) such as the cylinder head or any external electrical screening parts. Preventing this external field avoids the possibility of high uncontrolled losses or large changes in inductance reducing performance of the ignition system.

Figure 5:
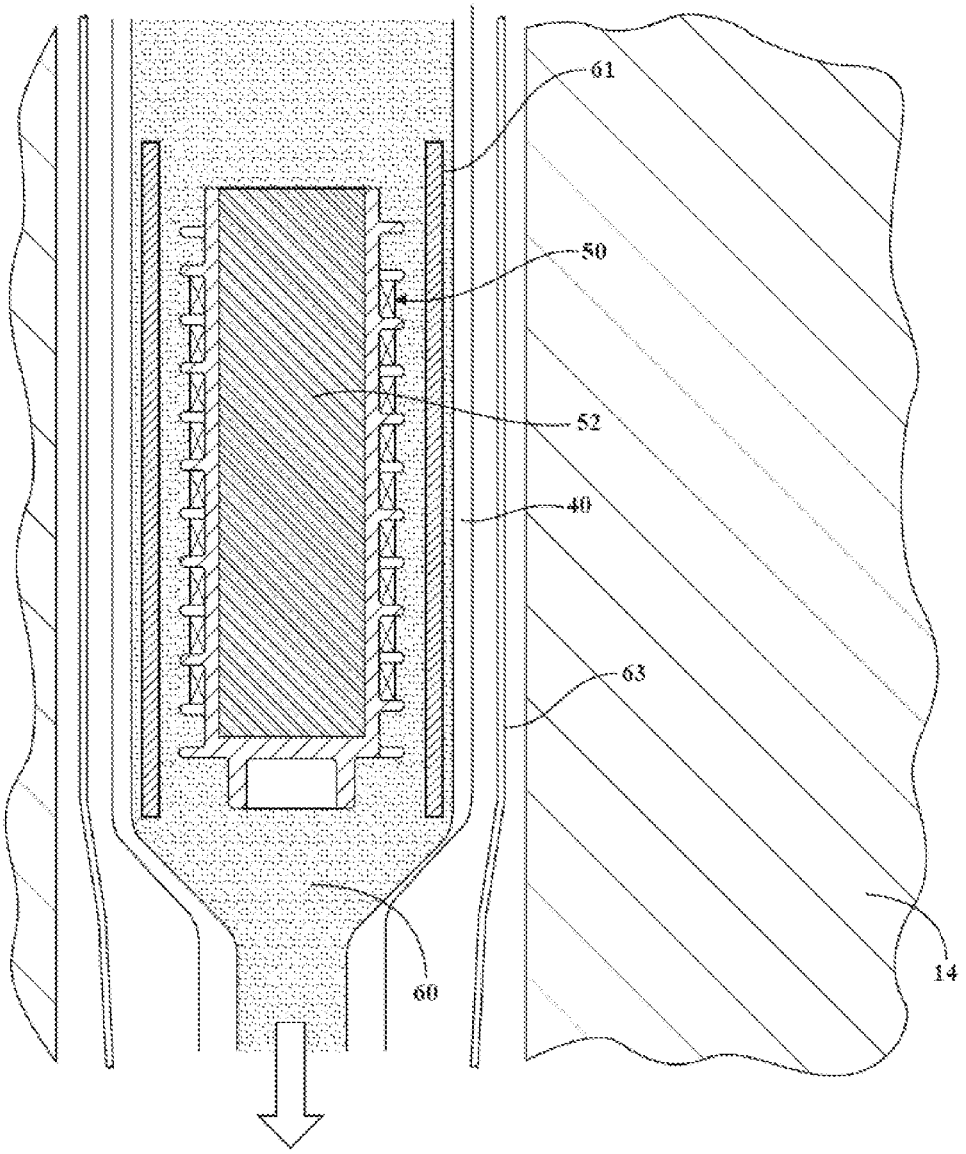
FIG. 5 is an exploded view of the ignitor assembly of FIG. 3 according to another embodiment of the invention.

With reference to FIG. 4, the inductor winding 50 is made on an electrically insulating bobbin surrounding the central core 52. This is installed in a non-magnetic housing 40 which may be filled with suitable material to provide electrical insulation and/or mechanical support and/or thermal management benefits, as known in the art and described herein above. This assembly is installed at least partly into a cavity in an engine cylinder head 14, designed to give access to the ignition source (firing end, not shown). Around the assembly may also include an electrically conductive shield or screen 63 designed to limit radiation of EM interference. External magnetic screening shield 61 is included with a cross sectional area large enough to carry the magnetic flux of inductor winding 50 without saturation. This material may be of any of the suitable known types, such as ferrites of MN—ZN or NI—ZN, powdered iron or any other as known in the art. In this embodiment, the central core 52 is made of a non-magnetic material compound during construction. The screen material will preferably have low losses in the frequency range 500 Khz to 5 Mhz, and have electrical resistivity high enough to avoid significant eddy current losses. To ensure that magnetic flux is contained within the igniter, the external magnetic screen 61 should be at least as long as the electrical winding, and preferably extend beyond its ends by a distance at least equal to the radius of the winding 50. The material may have a relative permeability chosen to give the desired final inductance depending on the igniter geometry.

Where a higher inductance is required, the core material 52 may also be made magnetically permeable, as shown in FIG. 5. In this case, it is advantageous if the central core 52 is at least as long as the winding 50, and the external magnetic shield 61 should be at least as long as core 52, and preferably extend beyond the ends of the core 52 by a distance at least equal to the radius of the winding 50. The central core 52 need not be the same material as the magnetic shield 61.

Inductance may be further controlled in the usual way for magnetic circuits; by the introduction of air gaps in the magnetic shield 61 or central core 52, or reducing cross section to cause controlled saturation. Providing any gaps introduced in the external magnetic shield 61 are small compared to the gap between the external shield 61 and inductor winding 50 and engine structure 14.

The external magnetic shield 61 is able to greatly reduce the losses from the igniter, prevent sensitivity to external components (e.g. metallic screen or cylinder head components) and provide a well-controlled behavior in magnetic and electrical performance. Naturally, this method of external magnetic screening may also be advantageously applied to microwave/RF ignition systems where the inductor is of a different form factor, for example if the inductor is mounted outside the engine's plug well.

As shown in FIG. 6, the assembly 10 is constructed to be mounted within an ignitor bore 12 of a cylinder head 14 that is configured to be joined to an engine block 16 of an internal combustion engine 18. The engine block 16 includes a combustion cylinder 20 in which a piston (not shown) reciprocates. The engine 18 may have a plurality of such combustion cylinders 20 and associated pistons. The ignitor bore 12 can be constructed to extend along a straight axis, or, if desired, along multiple non-parallel axes, such as may be desired to route around other adjacent engine features, such as a fuel injector bore 19 in which a fuel injector head (not shown) is received for injecting a fuel/air mixture into the combustion cylinder 20 and/or a valve bore 21 in which a valve assembly 23 is received, for example. It is appreciated that this embodiment is merely exemplary in nature and not limited thereto.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A corona ignitor device configured to be fixed within a combustion chamber and for providing a corona discharge in the combustion chamber, comprising:

a housing extending between an upper end and a lower end of the ignitor device;

inductor windings received in said housing between said upper and lower ends; and a magnetic shield located around the inductor windings to prevent magnetic flux from emanating out of the ignitor device.

2. The corona ignitor assembly of claim 1, further comprising:

an inductor subassembly including said housing and having a first electrical connector and a second electrical, said first electrical connector being configured in electrical communication with said second electrical connector via said inductor windings; and a firing end subassembly having a ceramic insulator and a metal housing surrounding at least a portion of said ceramic insulator, said ceramic insulator extending between a terminal end and a firing end with an electrical terminal extending from said terminal end in electrical contact with said second electrical connector and an electrode extending from said firing end for providing the corona discharge, said electrode being configured in electrical communication with said electrical terminal.

3. The corona ignitor assembly of claim 2, further comprising a conductive shield at least partially surrounding the housing to limit radiation of EM interference.

4. The corona ignitor assembly of claim 2, wherein the magnetic shield has a relatively high magnetic permeability with low electrical conductivity and substantially encloses the inductor windings to prevent the magnetic flux from emanating out of the ignitor assembly.

5. The corona ignitor assembly of claim 4, wherein the magnetic shield is a ferrite material including at least one of MN—ZN, NI—ZN and powdered iron.

6. The corona ignitor assembly of claim 4, wherein the magnetic shield has low losses in the frequency range 500 KHz to 5 MHz and an electrical resistivity to at least limit eddy current losses.

7. The corona ignitor assembly of claim 4, wherein the housing is filled with at least one of a pressurized gas, non-pressurized gas and resin about the inductor windings for high voltage suppression.

8. The corona ignitor assembly of claim 2, wherein the inductor windings surround a central core, the central core is magnetically permeable and at least as long as the inductor windings, and the magnetic shield is at least as long as the central core.

9. The corona ignitor assembly of claim 2, wherein said inductor windings present a radius and surround a central core, said central core extends between opposite ends, and the magnetic shield extends beyond the ends of the central core by a distance at least equal to the radius of the inductor windings.

10. The corona ignitor assembly of claim 8, wherein one or more gaps are introduced into the magnetic shield and/or core material.

11. The corona ignitor assembly of claim 2, wherein said inductor windings present a radius and surround a central core, and the central core is longer than the windings by a distance at least equal to said radius.

12. The corona ignitor assembly of claim 2, wherein said inductor windings present a radius and surround a central core, and the length of the magnetic shield extends at least one radius beyond the winding or the central core when it is magnetic.

13. The corona ignitor assembly of claim 9, wherein said central core is at least as long as said inductor windings.

* * * * *